US006869651B2

(12) United States Patent
Pan et al.

(10) Patent No.: US 6,869,651 B2
(45) Date of Patent: Mar. 22, 2005

(54) SUBSTRATE WITH RAISED SURFACE PORTION

(75) Inventors: Sean X. Pan, Penfield, NY (US); Mark C. Petropoulos, Ontario, NY (US); Linnette Perales Rivera, Webster, NY (US); Jeremy B. Pinsly, Jacksonville, FL (US); Zhilei Wang, Penfield, NY (US); Mark S. Thomas, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 460 days.

(21) Appl. No.: 10/020,991

(22) Filed: Dec. 19, 2001

(65) Prior Publication Data

US 2003/0113469 A1 Jun. 19, 2003

(51) Int. Cl.[7] ..... B05D 7/00
(52) U.S. Cl. ..... 428/35.7; 427/407.1; 427/430.1
(58) Field of Search ..... 427/407.1, 430.1; 428/35.7

(56) References Cited

U.S. PATENT DOCUMENTS

| | | | | |
|---|---|---|---|---|
| 5,385,759 | A | 1/1995 | Crump et al. | 427/430.1 |
| 5,578,410 | A | 11/1996 | Petropoulos et al. | 430/133 |
| 5,633,046 | A | 5/1997 | Petropoulos et al. | 427/430.1 |
| 5,683,742 | A | 11/1997 | Herbert et al. | 427/11 |
| 6,132,810 | A | 10/2000 | Swain et al. | 427/430.1 |
| 2003/0113468 | A1 | 6/2003 | Perry et al. | 427/430.1 |
| 2003/0113470 | A1 | 6/2003 | Pan et al. | 427/430.1 |
| 2003/0113471 | A1 | 6/2003 | Pan et al. | 427/430.1 |

FOREIGN PATENT DOCUMENTS

| | | | | |
|---|---|---|---|---|
| CH | 672564 A | * | 11/1989 | H02G/3/22 |
| JP | 06059465 A | * | 3/1994 | G03G/5/00 |

* cited by examiner

*Primary Examiner*—Sandra M. Nolan
(74) *Attorney, Agent, or Firm*—Zosan S. Soong

(57) ABSTRACT

An apparatus including:

(a) a substrate including a deposition region and an optional uncoated region, wherein the deposition region includes a level intermediate region disposed between a first end region and a second end region, wherein the first end region includes a first raised surface portion extending above the level intermediate region and extending circumferentially around the first end region in a continuous manner; and (b) a dip coated layer over the entire deposition region.

19 Claims, 6 Drawing Sheets

SUBSTRATE WITH RAISED SURFACE PORTION

BACKGROUND OF THE INVENTION

When a photoreceptor is dip coated, the layer thickness increases slowly to a target value after the takeup speed reaches a constant value. The resulting non-uniformity in layer thickness is called "sloping." "Sloping" of the deposited layer over the imaging area of the photoreceptor is undesirable since it can degrade the performance of the photoreceptor. To prevent the deposited layer from exhibiting "sloping" in the imaging area, one can use a longer substrate to provide a longer non-imaging area so that the "sloping" of the deposited layer occurs only in the non-imaging area while the deposited layer exhibits relatively uniform thickness in the imaging area. However, a longer substrate and a longer non-imaging area increase costs since more materials have to be used in the substrate and the deposited layer or layers. Thus, there is a need, which the present invention addresses, for new methods to eliminate or reduce the above described problem.

Coating methods and apparatus are described in Petropoulos et al., U.S. Pat. No. 5,633,046; Herbert et al., U.S. Pat. No. 5,683,742; Swain et al., U.S. Pat. No. 6,132,810; Petropoulos et al., U.S. Pat. No. 5,578,410; and Crump et al., U.S. Pat. No. 5,385,759.

SUMMARY OF THE INVENTION

The present invention is accomplished in embodiments by providing an apparatus comprising:

(a) a substrate including a deposition region and an optional uncoated region, wherein the deposition region includes a level intermediate region disposed between a first end region and a second end region, wherein the first end region includes a first raised surface portion extending above the level intermediate region and extending circumferentially around the first end region in a continuous manner; and (b) a dip coated layer over the entire deposition region.

There is also provided in embodiments an apparatus comprising:

(a) a substrate defining a longitudinal axis and including a deposition region and an optional uncoated region, wherein the deposition region includes a level intermediate region disposed between a first end region and a second end region, wherein the first end region includes a plurality of raised surface portions, each of the raised surface portions extending above the level intermediate region and extending only partially around the first end region, wherein the plurality of the raised surface portions, when viewed at a substrate end view, collectively extend circumferentially around the first end region in a continuous manner; and (b) a dip coated layer over the entire deposition region.

There is provided in further embodiments a coating method comprising:

(a) providing a substrate including a deposition region and an optional uncoated region, wherein the deposition region includes a level intermediate region disposed between a first end region and a second end region, wherein the first end region includes a first raised surface portion extending above the level intermediate region and extending circumferentially around the first end region in a continuous manner; and.

(b) dip coating a layer of a coating solution over the entire deposition region.

BRIEF DESCRIPTION OF THE DRAWINGS

Unless otherwise noted, the same reference numeral in different Figures refers to the same or similar feature.

DETAILED DESCRIPTION

As used herein, the phrase "coating solution" encompasses any fluid composition including the liquid medium and the coating material regardless of the extent that the coating material may be dissolved in the liquid medium.

Figure 1:
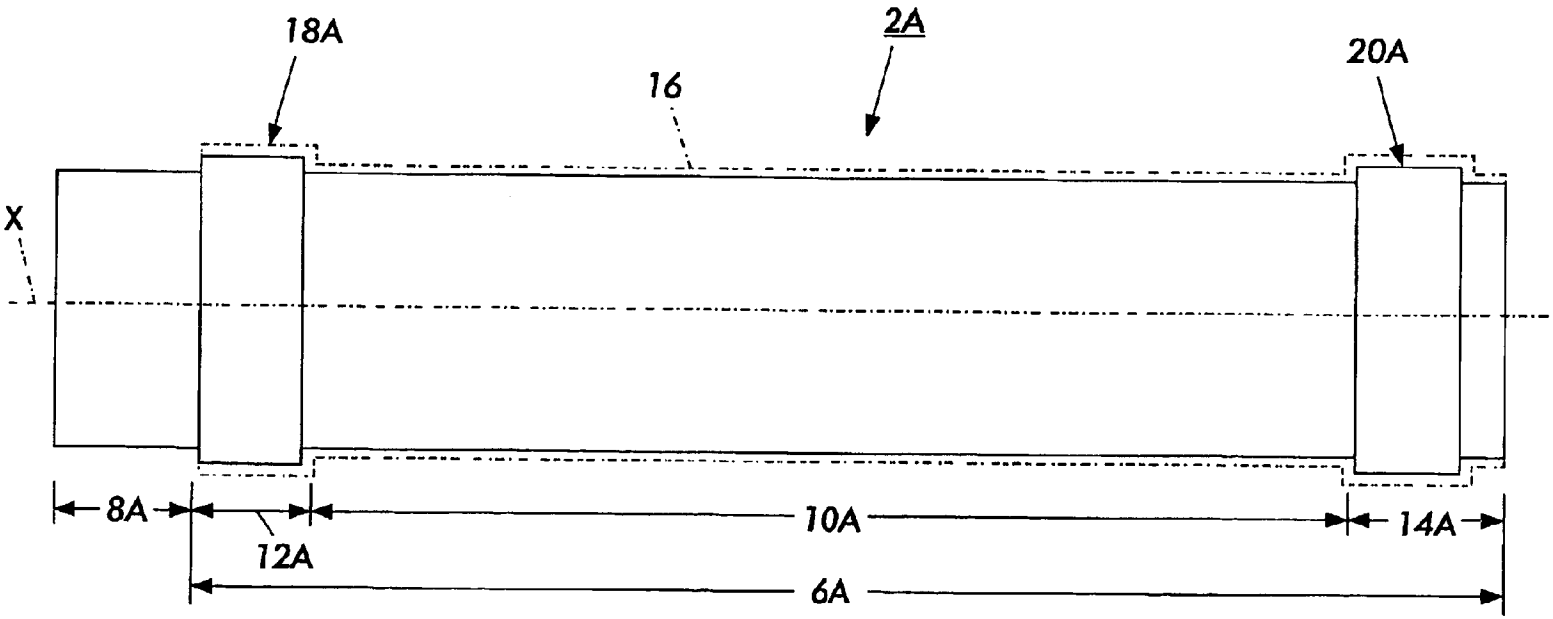
FIG. 1 is an elevational view of a first embodiment of the present coated substrate.

As seen in the Figures, the substrate (2A, 2B, 2C, 2D, 2E), having a longitudinal axis X, defines on its outer surface a deposition region (6A, 6B, 6C, 6D, 6E) and an optional uncoated region (8A, 8B, 8C, 8D), wherein the deposition region includes an intermediate region (10A, 10B, 10C, 10D, 10E) disposed between a first end region (12A, 12B, 12C, 12D, 12E) and a second end region (14A, 14B, 14C, 14D, 14E). In embodiments where the substrate is part of an electrostatographic imaging member (e.g., a photoreceptor), one or more of the first end region, the second end region, and the optionally uncoated region may correspond to a non-imaging area of the imaging member, whereas the imaging area of the imaging member includes at least the intermediate region and optionally one or both of the first end region and the second end region. In embodiments, the first end region, the second end region, and the optional uncoated region correspond to the non-imaging area of the imaging member, and the intermediate region corresponds to the imaging area. In FIG. 1, a dip coated layer 16 is formed over the entire deposition region.

In FIG. 1, the first end region 12A includes a first raised surface portion 18A which is depicted as a single band having a rectangular shape when viewed in cross section along the longitudinal axis that extends circumferentially around the first end region in a continuous manner. The second end region 14A optionally includes a second raised surface portion 20A similar or dissimilar to the first raised surface portion. In FIG. 1, the second raised surface portion 20A is depicted as a single band having a rectangular shape when viewed in cross section along the longitudinal axis that extends circumferentially around the second end region in a continuous manner.

Figure 2:
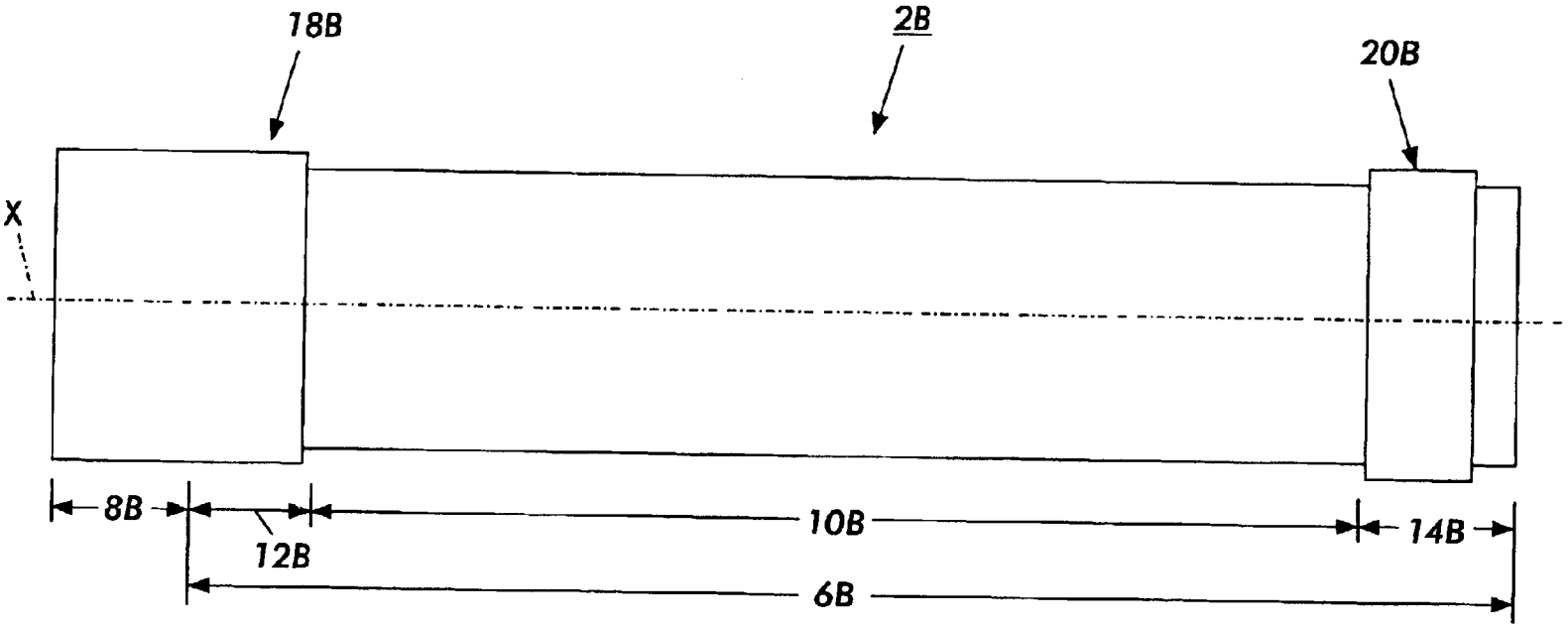
FIG. 2 is an elevational view of a second embodiment of the substrate useful in the present invention.

In FIG. 2, the first raised surface portion 18B is depicted as a single band having an elongated rectangular shape when viewed in cross section along the longitudinal axis that extends circumferentially around the first end region 12B and the uncoated region 8B in a continuous manner. In FIG. 2, the second raised surface portion 20B is depicted as a single band having a rectangular shape when viewed in cross section along the longitudinal axis that extends circumferentially around the second end region in a continuous manner.

Figure 3:
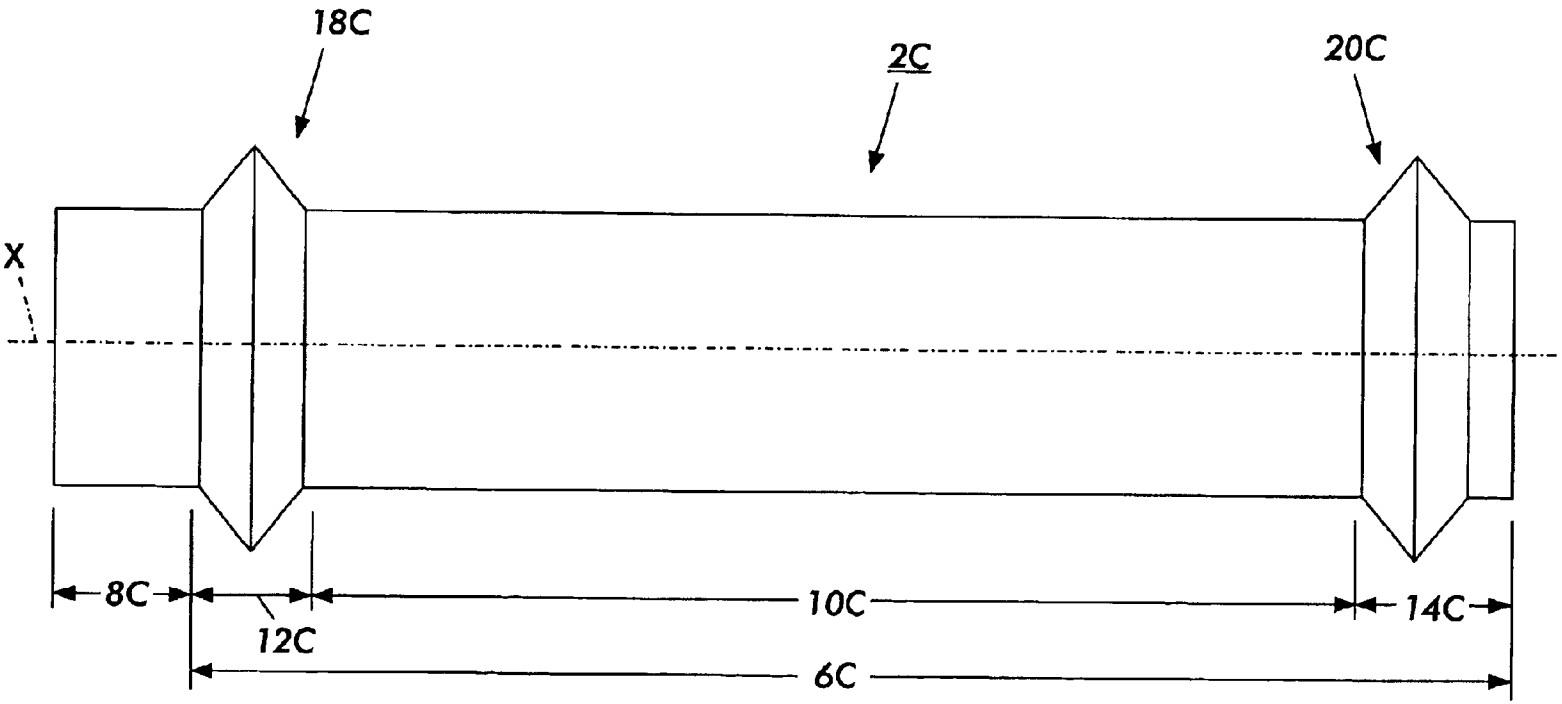
FIG. 3 is an elevational view of a third embodiment of the substrate useful in the present invention.

In FIG. 3, the first raised surface portion 18C and the second raised surface portion 20C are depicted as single bands (having a triangular shape when viewed in cross section along the longitudinal axis) extending circumferentially around the respective first end region and the second end region in a continuous manner.

Figure 4:
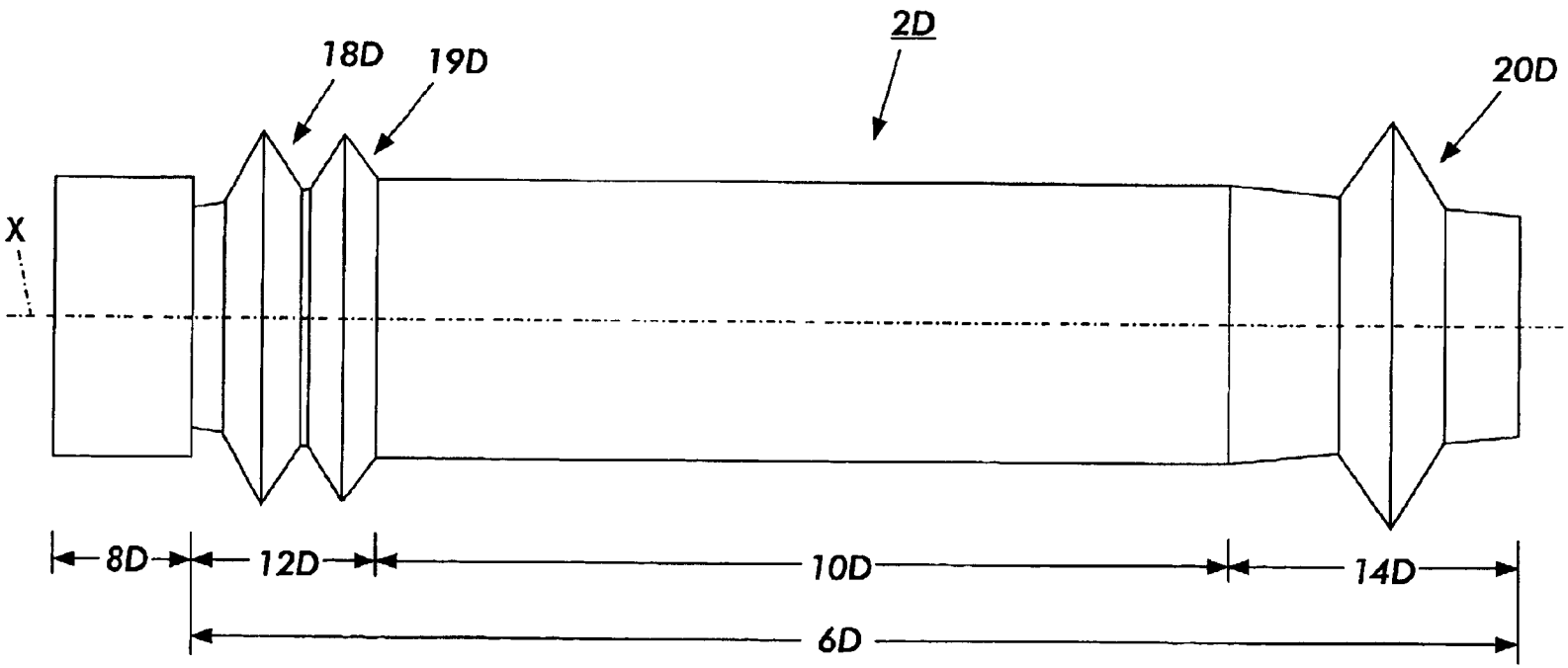
FIG. 4 is an elevational view of a fourth embodiment of the substrate useful in the present invention.

In FIG. 4, the first end region 12D includes a plurality of raised surface portions (18D, 19D), each raised surface portion extending circumferentially around the first end region in a continuous manner. Each raised surface portion (18D, 19D) is depicted as having a triangular shape when viewed in cross section along the longitudinal axis. The plurality of raised surface portions in the first end region may range in number for example from 2 to 5. The plurality of raised surface portions may be arranged in any suitable manner with respect to one another such as regular or irregular spacing and parallel or non-parallel arrangement. Moreover, each of the plurality of raised surface portions may be the same or different from one another in shape, surface height, size, and the like. The optional second raised surface portion 20D is depicted as a single band (having a triangular shape when viewed in cross section along the longitudinal axis) extending circumferentially around the second end region in a continuous manner. In FIG. 4, the portions of the first end region 12D and the second end region 14D not occupied by the raised surface portions (18D, 19D, 20D) are depicted as tapered surfaces.

Figure 5:
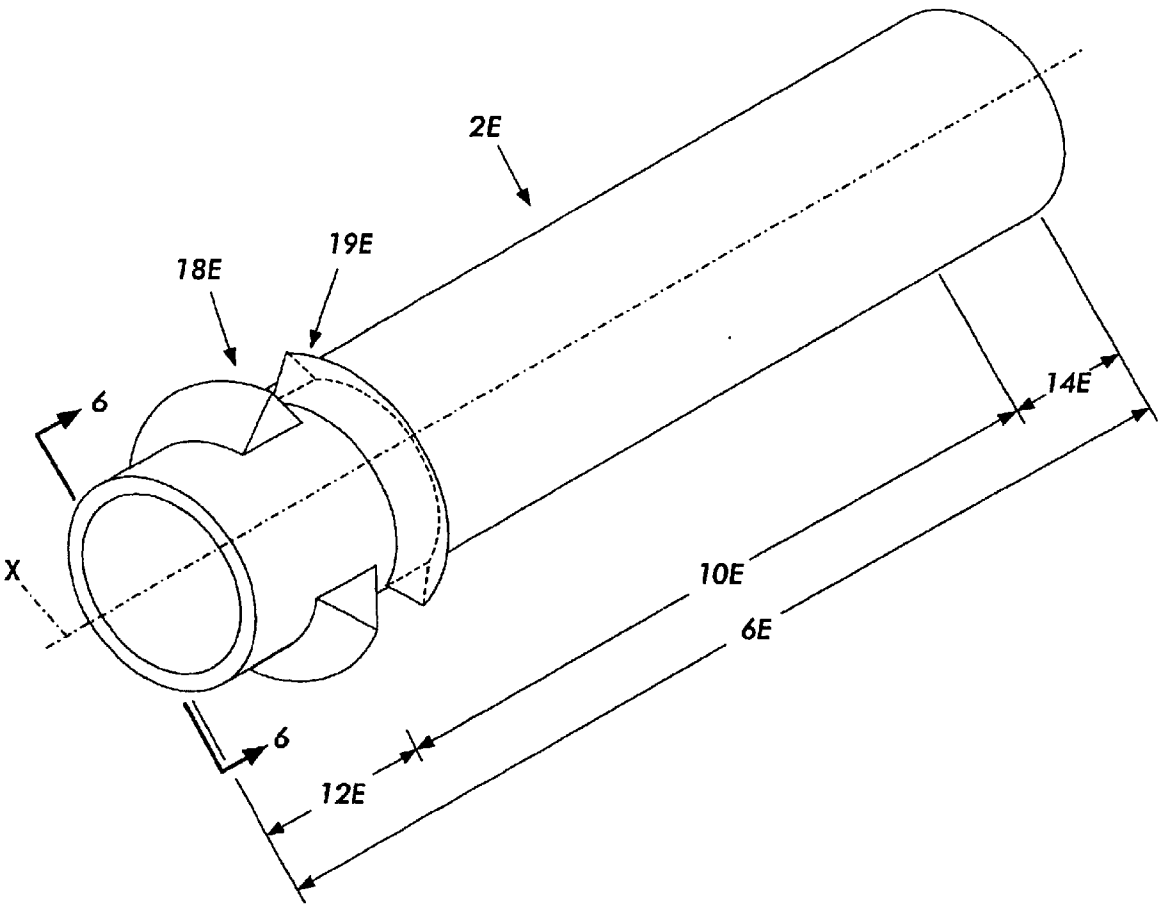
FIG. 5 is an elevational view of a fifth embodiment of the substrate useful in the present invention.
Figure 6:
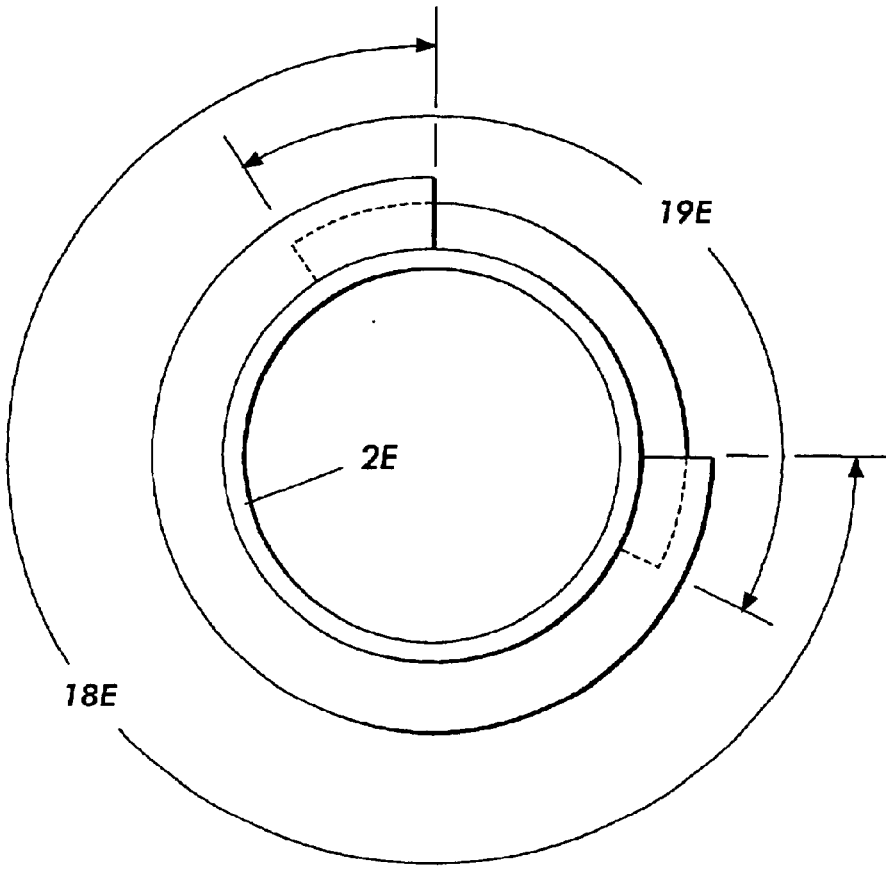
FIG. 6 is an end view of the substrate depicted in FIG. 5.

FIGS. 5–6 depict on the first end region 12E a plurality of raised surface portions (18E, 19E), each raised surface portion extending only partially around the first end region, wherein the plurality of the raised surface portions (18E, 19E), when viewed at a substrate end view, collectively extend circumferentially around the first end region in a continuous manner (also referred herein as "partial raised surface portions"). The plurality of partial raised surface portions may range in number from 2 to 5. The partial raised surface portions may be spaced at regular or irregular intervals (along the longitudinal axis) at a spacing ranging from 0 to about 1 cm, and particularly from about 1 mm to about 5 mm. In FIGS. 5–6, there are absent an uncoated region and any raised surface portion on the second end region.

In embodiments of the present invention, each raised surface portion extends above the level intermediate region by a value ranging for example from about 0.5 to about 1,000 micrometers, and particularly from about 4 to about 100 micrometers. Each raised surface portion may have a width (i.e., along the longitudinal axis) ranging for example from about 0.5 micrometer to about 100 mm, and particularly from about 10 micrometers to about 10 mm. Moreover, when viewed in cross section along the longitudinal axis, each raised surface portion may have any suitable shape such as a triangular (e.g., isosceles, equilateral, right, and obtuse), a square, a rectangular, a half circle, and the like. The top surface of each raised surface portion when viewed in cross section along the longitudinal axis may be a straight line parallel to the longitudinal axis, a tapered line, a curved line, a peak, a series of steps, and the like. The raised surface portion or portions may occupy a part of or all of the first end region. The raised surface portion or portions may occupy a part of or all of the second end region. Different types of raised surface portions may be used. By extending the raised surfaced portion or portions circumferentially around one or both end regions in a continuous manner, the likelihood is eliminated or minimized that the coating solution will bypass the raised surface portion or portions.

The raised surface portions may be formed by any suitable method including for instance by machining the substrate with a diamond tipped tool.

The term "level" indicates that the particular surface at issue (e.g., intermediate region) is parallel to the longitudinal axis.

In embodiments, the dip coated layer exhibits a substantially uniform thickness over the entire deposition region, particularly over the intermediate region. The phrase "substantially uniform thickness" indicates that the dry coating thickness over the deposition region varies by no more than about 10%, particularly no more than about 5%, based on the largest thickness value of the dip coated layer.

The present method is believed to be based on the phenomenon of "capillary retention." When liquid is placed on a horizontal surface that is rough with a raised area and a depressed area, liquid will distribute more in the depressed areas per unit area due to surface tension of liquid and gravity. When such rough surface with liquid is positioned vertically, the liquid will flow downward. The contact angle based on the smooth surface is higher in the raised area than in the depressed area. Capillary force will exert driving force for the liquid to flow from the raised area to the depressed area. As a result, there is a higher percentage of liquid in the raised area flowing out. The most solution is retained in the depressed area, especially in the lower positions due to gravity. After the raised area is dip coated, the capillary force and gravity drag and deposit more of the coating solution in the surface area following the raised area. In the present invention, the raised surface portion functions as the raised area. Due to the presence of the raised surface portion, more of the coating solution is deposited in the dip coated layer over the intermediate region than would have occurred in the absence of the raised surface portion. Consequently, greater deposition of the coating solution over the intermediate region increases the coating thickness uniformity of the dip coated layer over the intermediate region. For photoreceptors, greater coating thickness uniformity of the dip coated layer in the imaging area improves performance as compared with a photoreceptor exhibiting pronounced sloping of the dip coated layer in the imaging area.

The phrase "dip coating" encompasses the following techniques to deposit layered material onto a substrate: moving the substrate into and out of the coating solution; raising and lowering the coating vessel to contact the coating solution with the substrate; positioning the substrate in a vessel containing the coating solution and then draining the coating solution from the vessel.

The substrate may be moved into and out of the solution at any suitable speed including the takeup speed indicated in Yashiki et al., U.S. Pat. No. 4,610,942, the disclosure of which is hereby totally incorporated by reference. The dipping speed to contact the substrate with the coating solution may range for example from about 50 to about 3,000 mm/min and may be a constant or changing value. The takeup speed to withdraw the substrate from the coating solution may range for example from about 50 to about 500 mm/min and may be a constant or changing value. Any suitable dipping speed and takeup speed, including those discussed herein, can be used to deposit the desired layer or layers.

For the deposited layer or layers, each layer has a thickness ranging for example from about 0.05 to about 75 micrometers, and particularly from about 3 to about 40 micrometers. Unless otherwise indicated, the disclosed thickness value for each layer is a dry thickness value.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate can vary in thickness over substantially wide ranges depending on its desired use. Generally, the conductive layer ranges in thickness from about 50 Angstroms to about 30 micrometers, although the thickness can be outside of this range. When a flexible electrophotographic imaging member is desired, the substrate thickness typically is from about 0.015 mm to about 0.15 mm. When a rigid, hollow imaging member is desired, the substrate thickness is typically from about 0.5 mm to about 5 mm. The substrate can be fabricated from any other conventional material, including organic and inorganic materials. Typical substrate materials include insulating non-conducting materials such as various resins known for this purpose including polycarbonates, polyamides, polyurethanes, paper, glass, plastic, polyesters such as MYLAR® (available from DuPont) or MELINEX®447 (available from ICI Americas, Inc.), and the like. If desired, a conductive substrate can be coated onto an insulating material. In addition, the substrate can comprise a metallized plastic, such as titanized or aluminized MYLAR®. The substrate can be flexible or rigid, and can have any number of configurations such as a cylindrical drum, an endless flexible belt, and the like.

The substrate and coating solution are described herein as being used in the fabrication of a photoreceptor. However, the present invention is not limited to the fabrication of a photoreceptor. In embodiments, the present invention uses other substrates and coating solutions not specifically described herein which are useful for other applications.

Any suitable coating solution can be used to form the layer or layers deposited over the substrate. In embodiments, the coating solution may comprise materials typically used for any layer of a photoreceptor including such layers as a charge barrier layer, an adhesive layer, a charge transport layer, and a charge generating layer, such materials and amounts thereof being illustrated for instance in U.S. Pat. No. 4,265,990, U.S. Pat. No. 4,390,611, U.S. Pat. No. 4,551,404, U.S. Pat. No. 4,588,667, U.S. Pat. No. 4,596,754, and U.S. Pat. No. 4,797,337, the disclosures of which are totally incorporated by reference.

In embodiments, a coating solution may include the materials for a charge barrier layer including for example polymers such as polyvinylbutyral, epoxy resins, polyesters, polysiloxanes, polyamides, or polyurethanes. Materials for the charge barrier layer are disclosed in U.S. Pat. Nos. 5,244,762 and 4,988,597, the disclosures of which are totally incorporated by reference.

The optional adhesive layer preferably has a dry thickness between about 0.001 micrometer to about 0.2 micrometer. A typical adhesive layer includes film-forming polymers such as polyester, du Pont 49,000 resin (available from E. I. du Pont de Nemours & Co.). VITEL-PE100™ (available from Goodyear Rubber & Tire Co.), polyvinylbutyral, polyvinylpyrrolidone, polyurethane, polymethyl methacrylate, and the like. In embodiments, the same material can function as an adhesive layer and as a charge blocking layer.

In embodiments, a charge generating solution may be formed by dispersing a charge generating material selected from azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. A representative charge generating solution comprises: 2% by weight hydroxy gallium phthalocyanine; 1% by weight terpolymer of vinyl acetate, vinyl chloride, and maleic acid; and 97% by weight cyclohexanone.

In embodiments, a charge transport solution may be formed by dissolving a charge transport material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like. An illustrative charge transport solution has the following composition: 10% by weight N,N'-diphenyl-N,N'-bis(3-methylphenyl)-(1,1'-biphenyl)-4, 4'diamine; 14% by weight poly(4,4'-diphenyl-1,1'-cyclohexane carbonate) (400 molecular weight); 57% by weight tetrahydrofuran; and 19% by weight monochlorobenzene.

A coating solution may also contain a liquid medium, preferably an organic liquid medium, such as one or more of the following: tetrahydrofuran, monochlorobenzene, and cyclohexanone.

After all the desired layers are coated onto the substrate, the coated layers may be subjected to elevated drying temperatures such as from about 100 to about 160° C. for about 0.2 to about 2 hours.

Other modifications of the present invention may occur to those skilled in the art based upon a reading of the present disclosure and these modifications are intended to be included within the scope of the present invention.

We claim:

1. An apparatus comprising:

(a) a substrate including a deposition region and an optional uncoated region, wherein the deposition region includes a level intermediate region disposed between a first end region and a second end region, wherein the first end region includes a first raised surface portion extending above the level intermediate region and extending circumferentially around the first end region in a continuous manner wherein the first raised surface portion extends above the level intermediate region by a value ranging from about 0.5 to about 1,000 micrometers; and (b) a dip coated layer over the entire deposition region including over the first raised surface portion.

2. The apparatus of claim 1, wherein the substrate is a cylinder.

3. The apparatus of claim 1, wherein the uncoated region is present.

4. The apparatus of claim 1, wherein the first raised surface portion has a triangular shape when viewed in cross section.

5. The apparatus of claim 1, wherein the first raised surface portion has a level top surface.

6. The apparatus of claim 1, where in the first raised surface portion extends into the uncoated region.

7. The apparatus of claim 1, wherein the clip coated layer comprises a charge transport material.

8. The apparatus of claim 1, wherein the portion of the dip coated layer over the intermediate region has a substantially uniform thickness.

9. The apparatus of claim 1, wherein the second end region includes a second raised surface portion extending above the level intermediate region and extending circumferentially around the second end region in a Continuous manner.

10. An apparatus comprising:

(a) a substrate defining a longitudinal axis and including a deposition region and an optional uncoated region, wherein the deposition region includes a level intermediate region disposed between a first end region and a second end region, wherein the first end region includes a plurality of raised surface portions, each of the raised surface portions extending above the level Intermediate region and extending only partially around the first cad region, wherein the plurality of the raised surface portions, when viewed at a substrate end view, collectively extend circumferentially around the first end region in a continuous manner; and (b) a dip coated layer over the entire deposition region including over the plurality of the raised surface portions.

11. The apparatus of claim 10, wherein the plurality of the raised surface portions ranges in number from 2 to 5.

12. A coating method comprising:

(a) providing a substrate including a deposition region and an optional uncoated region, wherein the deposition region includes a level intermediate region disposed between a first end region and a second end region, wherein the first end Legion includes a first raised surface portion extending above the level intermediate region and extending circumferentially around die first end region in a continuous manner; and (b) dip coating a layer of a coating solution over the entire deposition region including over the first raised surface portion.

13. The coating method of claim 12, wherein the substrate is a cylinder.

14. The coating method of claim 12, wherein the first raised surface portion extends above the level intermediate region by a value ranging from about 0.5 to about 1,000 micrometers.

15. The coating method of claim 12, wherein the first raised surface portion has a triangular shape when viewed in cross section.

16. The coating method of claim 12, wherein the tint raised surface portion has a level top surface.

17. The coating method of claim 12, wherein the rust raised surface portion extends into the uncoated region.

18. The coating method of claim 12, wherein the dip coated layer comprises a charge transport material.

19. The coating method of claim 12, wherein the portion of the dip coated layer over the intermediate region has a substantially uniform thickness.

* * * * *